US008561860B2

(12) United States Patent
Moriyama et al.

(10) Patent No.: US 8,561,860 B2
(45) Date of Patent: Oct. 22, 2013

(54) POUR SPOUT MEMBER FOR PACKAGING BAG

(75) Inventors: Yuichiro Moriyama, Toyama (JP); Kazuyoshi Shirai, Tokyo (JP); Yasumasa Tanaka, Tokyo (JP); Tomonari Shinohara, Tokyo (JP); Toshiharu Yoshida, Kawasaki (JP); Mayumi Oomori, Kawasaki (JP); Takeshi Tsutsumi, Tokyo (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 268 days.

(21) Appl. No.: 13/001,795

(22) PCT Filed: Jul. 8, 2009

(86) PCT No.: PCT/JP2009/003190

§ 371 (c)(1),
(2), (4) Date: Mar. 14, 2011

(87) PCT Pub. No.: WO2010/004746

PCT Pub. Date: Jan. 14, 2010

(65) Prior Publication Data

US 2011/0147415 A1 Jun. 23, 2011

(30) Foreign Application Priority Data

Jul. 11, 2008 (JP) ..... 2008-180937
Dec. 5, 2008 (JP) ..... 2008-310398

(51) Int. Cl.

| | |
|---|---|
| ***B65D 5/72*** | (2006.01) |
| ***B65D 25/40*** | (2006.01) |
| ***B65D 35/38*** | (2006.01) |
| ***B65D 47/10*** | (2006.01) |
| ***B65D 55/02*** | (2006.01) |

(52) U.S. Cl.
USPC ..... 222/566; 222/541.1; 222/541.6; 215/216

(58) Field of Classification Search
USPC ..... 222/153.05–153.07, 153.09, 153.1, 222/528, 541.1, 566, 567, 574, 222/541.5–541.9, 179.5, 182; 215/235, 215/250, 253
See application file for complete search history.

(56) References Cited

U.S. PATENT DOCUMENTS 3,356,244 A * 12/1967 Witchell ..... 215/49
3,519,158 A * 7/1970 Anderson ..... 215/247
3,612,323 A * 10/1971 Malick ..... 215/214

(Continued)

FOREIGN PATENT DOCUMENTS

JP 2000-142769 A 5/2000
JP 2006-62752 A 3/2006

(Continued)

*Primary Examiner* — Paul R Durand
*Assistant Examiner* — Benjamin R Shaw
(74) *Attorney, Agent, or Firm* — Birch, Stewart, Kolasch & Birch, LLP

(57) ABSTRACT

An improved pour spout member having a base attached to a packaging bag, a tubular neck having a tip opening sealed by a sealing member, and a lid member having an upper end connected to the sealing member and covering an outer periphery of the tubular neck. The lid member includes expandable lid segments having upper ends connected to a portion integral with the sealing member and, between the expandable lid segments in a collapsed state and a portion integral with the tubular neck, there is provided a rotation locking mechanism enabling temporary restriction of the lid member.

15 Claims, 10 Drawing Sheets

(56) References Cited

U.S. PATENT DOCUMENTS

| | | | | | |
|---|---|---|---|---|---|
| 3,703,975 | A | * | 11/1972 | Wittemer | 215/213 |
| 4,393,978 | A | * | 7/1983 | Kessler et al. | 215/253 |
| 4,480,762 | A | * | 11/1984 | Thomas | 215/273 |
| 4,752,013 | A | * | 6/1988 | Miller et al. | 215/216 |
| 4,948,002 | A | * | 8/1990 | Thornock et al. | 215/221 |
| 5,094,357 | A | * | 3/1992 | McKinney | 220/214 |
| 5,449,077 | A | * | 9/1995 | Seidler | 215/216 |
| 5,460,281 | A | * | 10/1995 | Rapchak et al. | 215/216 |
| 5,603,421 | A | * | 2/1997 | Opresco | 215/217 |
| 5,662,245 | A | * | 9/1997 | Grant | 222/153.07 |
| 5,979,681 | A | * | 11/1999 | PatrickJean-Luc Andre et al. | 215/216 |
| 6,036,036 | A | * | 3/2000 | Bilani et al. | 215/216 |
| 6,269,986 | B1 | * | 8/2001 | Gross | 222/541.5 |
| 6,273,307 | B1 | * | 8/2001 | Gross et al. | 222/566 |
| 6,283,318 | B1 | * | 9/2001 | Lee | 215/254 |
| 6,347,716 | B1 | * | 2/2002 | Nofer et al. | 215/235 |
| 7,185,790 | B2 | * | 3/2007 | Weiler | 222/153.07 |
| 2006/0070999 | A1 | * | 4/2006 | Stull et al. | 220/257.2 |
| 2007/0131721 | A1 | * | 6/2007 | Fritschi et al. | 222/391 |

FOREIGN PATENT DOCUMENTS

| | | | |
|---|---|---|---|
| JP | 2006-341908 | A | 12/2006 |
| JP | 2008-37461 | A | 2/2008 |
| WO | WO 2008/068861 | A1 | 6/2008 |

* cited by examiner

POUR SPOUT MEMBER FOR PACKAGING BAG

CROSS-REFERENCE TO RELATED APPLICATION

The present application claims priority under 35 U.S.C. §119 to Japanese Patent Application No. 2008-180937, filed Jul. 11, 2008, Japanese Patent Application No. 2008-310398, filed Dec. 5, 2008, and PCT/JP2009/003190 filed Jul. 8, 2009.

BACKGROUND OF THE INVENTION

1. Technical Field

The present invention relates to a pour spout member heat-sealed to a packaging bag and used to pour fluent liquid out from the packaging bag.

2. Related Art

As the pour spout member adapted to be heat sealed to the packing bag, a pour spout member comprising a base adapted to be heat sealed to the packaging bag, a threaded tubular neck and a lid member adapted to be threadably mounted on the tubular neck is conventionally used (See Japanese Patent Application Laid-Open Publication No. 2000-142769).

As another pour spout member of well known art, the pour spout member of a construction such that a tip opening of the pour spout is formed with a protrusion adapted to be twisted off, a cap is threadably mounted on a tubular neck as a whole forming the pour spout and the cap may be rotated to twist off the protrusion (See Japanese Patent Application Laid-Open Publication No. 2006-62752).

A pour spout member of a construction such that a tip opening of the pour spout is formed with a protrusion adapted to be twisted off, the protrusion is covered with a square U-shaped guard member and distal ends of the guard member are connected to a base of the pour spout member in a breakable manner to prevent the protrusion from unintentionally twisted off (See Japanese Patent Application Laid-Open Publication No. 2006-341908).

In the case of the pour spout member disclosed in Japanese Patent Application Laid-Open Publication No. 2000-142769), an inner stopple provided within the tubular neck must be by a handgrip attached to the inner stopple must be pulled out to open the pour spout. With such arrangement, there is a problem that not only operation of opening the pour spout is troublesome but it is sanitarily apprehended that the user's hand might come in contact with the pour spout.

In the case of the pour spout member disclosed in Japanese Patent Application Laid-Open Publication No. 2006-62752), there is anxiety that the protrusion might be readily twisted off when the cap is unintentionally rotated, for example, in the course of transit and, in addition, such pour spout is not craft-friendly.

In the case of the pour spout member disclosed in Japanese Patent Application Laid-Open Publication No. 2006-341908), the pour spout is exposed and its construction is complicated and correspondingly troublesome for working.

SUMMARY AND OBJECTS OF THE INVENTION

The problems set forth above are solved, according to the present invention, by an improvement in the pour spout member comprising a base adapted to be attached to a packaging bag, a tubular neck having a tip opening sealed by a sealing member and a lid member having an upper end connected to the sealing member and covering an outer periphery of the tubular neck. The improvement according to the present invention is characterized, as defined by claim 1, in that the lid member includes expandable lid segments having upper ends connected to a portion integral with the sealing member; and between the expandable lid segments in collapsed state and a portion integral with the tubular neck, there is provided a rotation locking mechanism adapted for temporary restriction of the lid member. The portion integral with the sealing member to which the respective upper ends of the paired expandable lid segments are connected, these paired expandable lid segments, and a part of the skirt portion of the lid member integral with the sealing member collectively define the lid member as a whole.

According to the present invention, the rotation locking mechanism temporarily locks the expandable lid segments.

According to, the expandable lid segments of the lid member are provided at distal ends thereof with handgrips used to expand the lid segments.

According to the, the distal ends of the respective expandable lid segments are provided with expansion restricting pieces by the intermediary of links; and, between the expansion restricting pieces and respective portions integral with the tubular neck, there are provided with rotation locking mechanisms serving to prevent the expansion restricting pieces from being released until said links are broken.

According to the present invention, the expansion restricting pieces are connected to the distal ends of the respective expandable lid segments by the intermediary of the breakable links According to the present invention, the expansion restricting pieces remain on the tubular neck after the rotation locking mechanisms have released the expandable lid segments from the tubular neck.

According to the present invention, the rotation locking mechanisms are provided with temporary lid locking frames.

According to the present invention, each of the expandable lid segments has an outside shape defined by an oval cross-sectional shape uniformly from its upper end connected to the sealing member to the distal end.

According to the present invention, the expandable lid segment is paired.

According to the present invention, the lid member is formed by a part of the lid member.

According to the present invention, the lid member comprises a pair of the expandable lid segments.

According to the present invention, with the lid member's paired expandable lid segments inclusive of the expansion restricting pieces being expanded substantially in horizontal position, the pour spout member is plastic molded by a molding tool comprising lateral molds serving to mold right and left sides of the tubular neck and the respective inner sides of the expandable lid segments, and top and bottom forces serving to mold the tubular neck interior, the sealing member inclusive of the connecting webs and the outer sides of the expandable lid segments.

According to the present invention, each of the paired expandable lid segments of the lid member has a substantially uniform inner diameter from the proximal end connected to the sealing member to the distal end.

According to the present invention, each of the paired expandable lid segments of the lid member has an inner diameter gradually enlarging from the proximal end connected to the sealing member to the distal end.

According to the present invention, the rotation locking mechanism comprises a protrusion formed on the tubular neck and an opening or a depression formed in the expansion restricting piece adapted to be engaged with said protrusion.

EFFECT OF THE INVENTION

According to the present invention, the pour spout member provided by the present invention comprises a base adapted to be attached to a packaging bag, a tubular neck having a tip opening sealed by a sealing member and a lid member having an upper end connected to the sealing member and covering an outer periphery of the tubular neck, wherein the lid member includes expandable lid segments having upper ends connected to a portion integral with the sealing member; and, between the expandable lid segments in collapsed state and a portion integral with the tubular neck, there is provided a rotation locking mechanism adapted for temporary restriction of the lid member. With such construction, the lid member is surely locked on the tubular neck by the rotation locking mechanisms so far as the paired expandable lid segments of the lid member mounted on the tubular neck are in collapsed state. Specifically, the lid member is locked on the tubular neck in the expanding direction as well as in the rotational direction and therefore it is not apprehended that the sealing member might be unintentionally opened, for example, in transit. In addition, the expandable lid segments of the lid member having been locked on the tubular neck by the rotation locking mechanisms may be released to easily twist off the sealing member having been fixed to the tubular neck without laying the user's hand on the tubular neck by rotating the lid member.

According to the present invention, the rotation locking mechanism temporarily locks the expandable lid segments. With such construction, the expandable lid segments having been locked on the tubular neck by means of the rotation locking mechanisms may be released in expansion direction to easily rotate the sealing member with the expanded slit segments held with the user's hand. Consequentially, the sealing member having been locked on the tubular neck can be easily rotated and twisted off without laying the user's hand on the tubular neck.

According to the present invention, the expandable lid segments of the lid member are provided at distal ends thereof with handgrips used to expand the lid segments. With such construction, the expandable lid segments can be easily expanded with the handgrips in the user's hand.

According to the present invention, wherein the distal ends of the respective expandable lid segments are provided with expansion restricting pieces by the intermediary of links; and, between the expansion restricting pieces and respective portions integral with the tubular neck there are provided with rotation locking mechanisms serving to prevent the expansion restricting pieces from being released until said links are broken. With such construction, the expandable lid segments f the lid member may be torqued against the effect of the expansion restricting pieces locked on the tubular neck by the rotation locking mechanisms to break off the links from the expansion restricting pieces and thereby to allow the lid member to be rotated. In this way, the sealing member having been fixed to the tubular neck can be easily rotated and twisted off without laying the user's hand on the tubular neck. Specifically, breaking off the expansion restricting pieces from the expandable lid segments of the lid member can demonstrate opening of the lid member and the state in which the expansion restricting pieces remain locked on the tubular neck by the intermediary of the links can demonstrate that the pour spout member is not in use.

According to the present invention, the expansion restricting pieces are connected to the distal ends of the respective expandable lid segments by the intermediary of the breakable links. With such construction, traces of separation between the expansion restricting pieces and the associated expandable lid segments can be left after the expansion restricting pieces have been separated from the associated expandable lid segments.

According to the present invention, the expansion restricting pieces remain on the tubular neck after the rotation locking mechanisms have released the expandable lid segments from the tubular neck. With such construction, the expandable lid segments can be reliably released from the expansion restricting pieces and the expansion restricting pieces left on the tubular neck visibly indicate that the pour spout member was used.

According to the present invention, the rotation locking mechanisms are provided with temporary lid locking frames. With such construction, unintentional drop off of the expansion restricting pieces from the tubular neck, for example, in the course of transit can be surely prevented.

According to the present invention, each of the expandable lid segments has an outside shape defined by an oval cross-sectional shape uniformly from its upper end connected to the sealing member to the distal end. With such construction, the seal member can be easily broken by rotating the lid member with the expandable lid segments in the hand.

According to the present invention, the expandable lid segment is paired. With such construction, the seal member can be easily broken by rotating the lid member with the paired expandable lid segments in the hand.

According to the present invention, the lid member is formed by a part of the lid member. With such construction, the rotation locking mechanisms can be formed by the expandable lid segments constituting a part of the lid member and adapted to cover the tubular neck and the sealing member can be twisted off by rotating the expandable lid segments in expanded state.

According to the present invention, the lid member comprises a pair of the expandable lid segments. With such construction, the lid member as a whole can be segmented into the expandable lid segments.

According to the present invention, with the lid member's paired expandable lid segments inclusive of the expansion restricting pieces being expanded substantially in horizontal position, the pour spout member is plastic molded by a molding tool comprising lateral molds serving to mold right and left sides of the tubular neck and the respective inner sides of the expandable lid segments, and top and bottom forces serving to mold the tubular neck interior, the sealing member inclusive of the connecting webs and the outer sides of the expandable lid segments. With such construction, the pour spout member can be produced by one-piece plastic molding.

According to the present invention, each of the paired expandable lid segments of the lid member has a substantially uniform inner diameter from the proximal end connected to the sealing member to the distal end. With such construction, the expandable lid segments having a substantially uniform inner diameter can be easily produced b plastic molding.

According to the present invention, each of the paired expandable lid segments of the lid member has an inner diameter gradually enlarging from the proximal end connected to the sealing member to the distal end. With such construction, the lateral molds serving to mold the inner side of the expandable lid segments can be easily released and even the expandable lid segments each having the inner diameter gradually enlarging from its proximal end to its distal end can be easily produced by the plastic molding.

According to the present invention, the rotation locking mechanism comprises a protrusion formed on the tubular neck and an opening or a depression formed in the expansion restricting piece adapted to be engaged with said protrusion. With such construction, the expansion restricting mechanisms can be easily constructed and locking as well as releasing can be reliably carried out.

further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
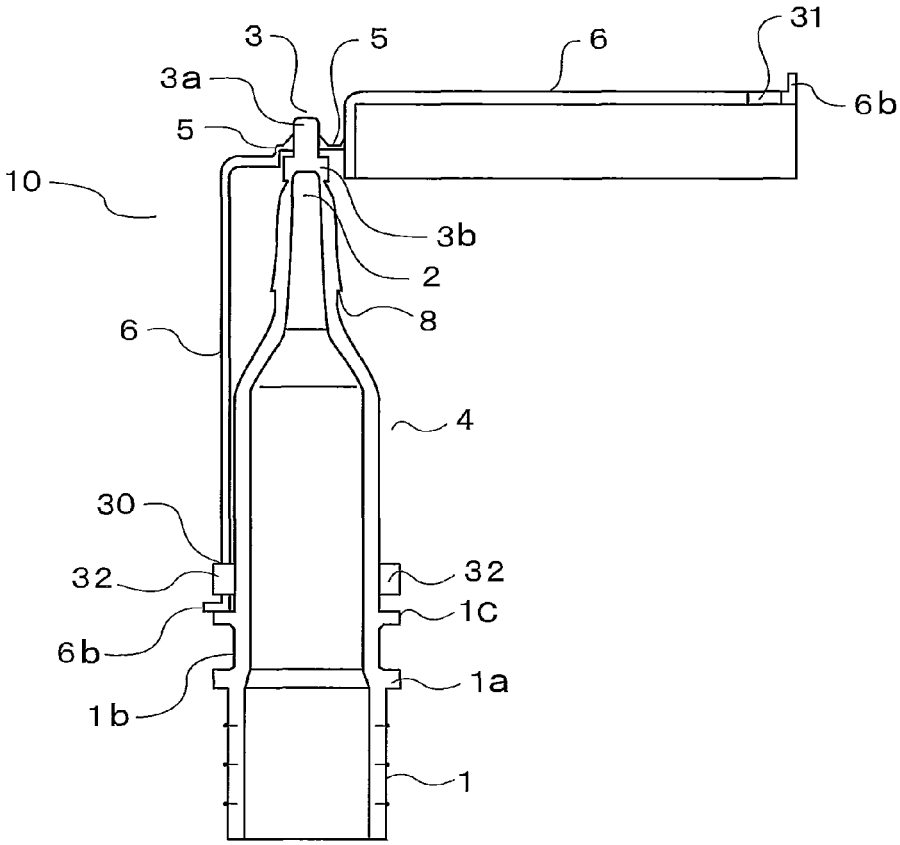
FIG. 1 is a simplified front longitudinal sectional view illustrating a manner of utilization of a pour spout member according to one embodiment of the present invention.

Details of the present invention will be more fully understood from the description of several embodiments thereof given hereunder in reference to the accompanying drawings.

Embodiment 1

In an embodiment illustrated by FIGS. 1 through 7, a pour spout member 10 for packaging bag according to the present invention comprises a base 1 adapted to be heat-sealed to the packing bag, a tubular neck 4 having a tip opening 2 sealed by a sealing member 3 and a lid member 20 having its upper end joined to the sealing member 3 by connecting webs 5 so as to cover an outer periphery of the tubular neck 4. In the pour spout member 10, said lid member 20 includes a pair of lid segments 6 segmented in an expandable manner and having respective upper ends connected to said sealing member 3. Between the respective lid segments 6 in collapse state and said tubular neck 4, there are provided a rotation locking mechanism 30 adapted to prevent the lid member 20 from rotating and to temporarily lock expansion of the paired lid segments 6.

Figure 7:
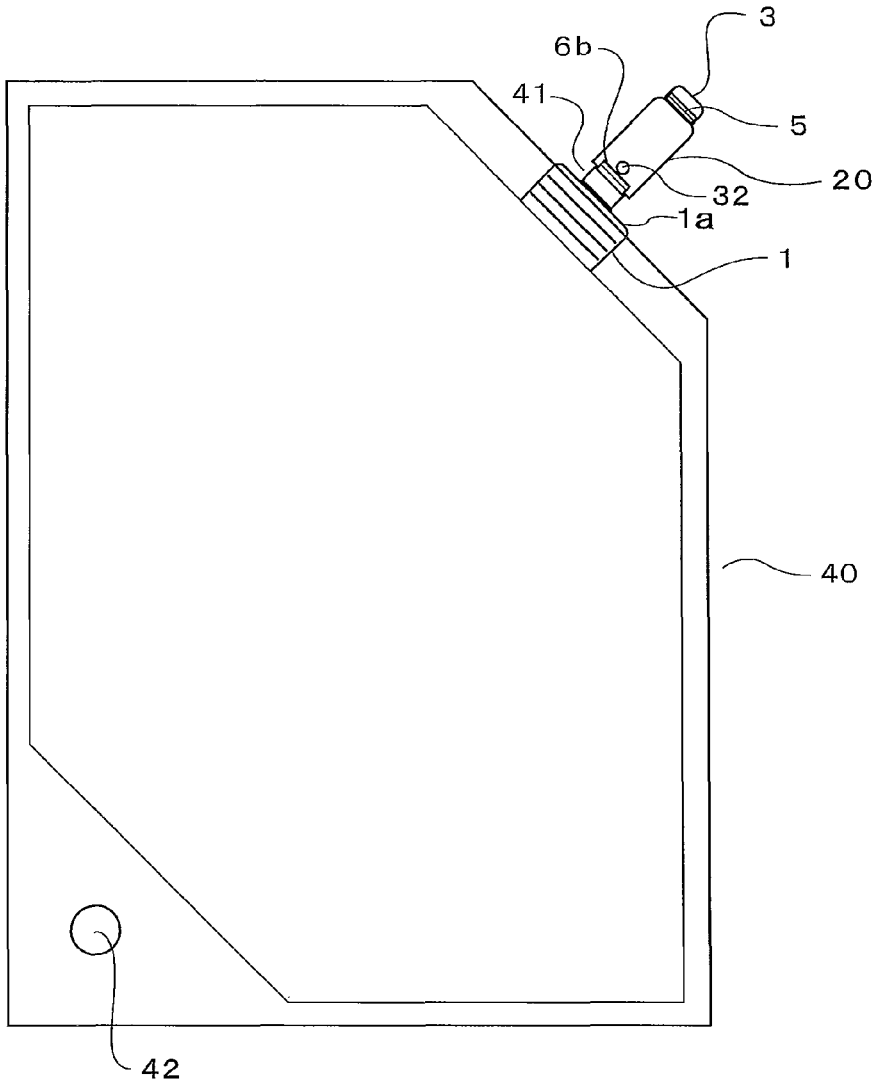
FIG. 7 is a schematic diagram illustrating a manner in which the pour spout member according to this embodiment is used.

As will be apparent from FIG. 7, the base 1 is provided with an apical plate 1*a* horizontally extending and serving as a top plate of a pour spout 41 of a packaging bag 40 when the base 1 is heat-sealed to this pour spout 41. Above this apical plate 1*a*, the base 1 is provided with a temporary lid locking frame 1*c* having a same shape as the apical plate 1*a* by the intermediary of a tubular spacer 1*b*. Referring to FIG. 7, reference numeral 42 designates a hole used for suspension of the bag 40.

Figure 2:
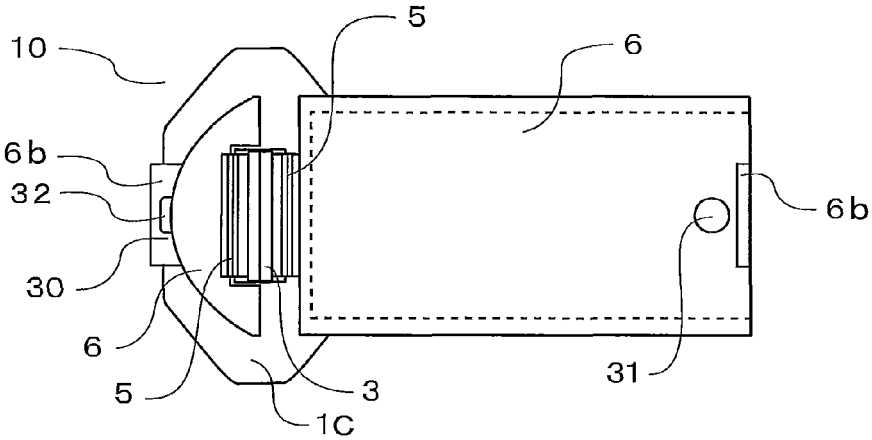
FIG. 2 is a simplified overhead view thereof.
Figure 3:
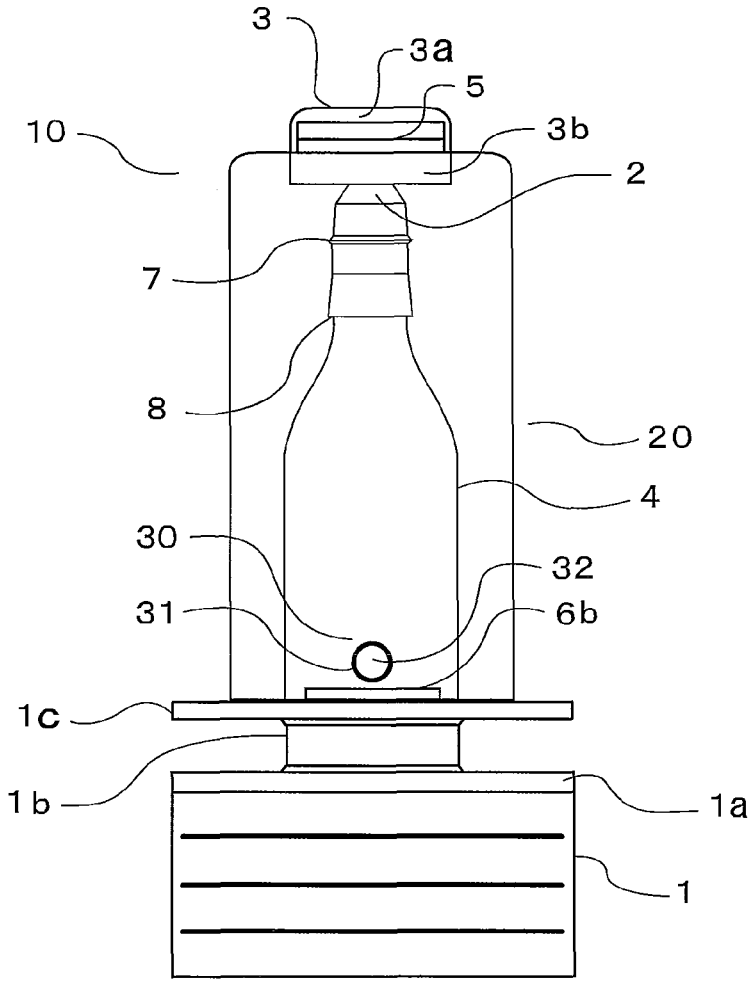
FIG. 3 is a simplified side view illustrating a manner of utilization thereof with expandable lid segments in collapsed state.
Figure 4:
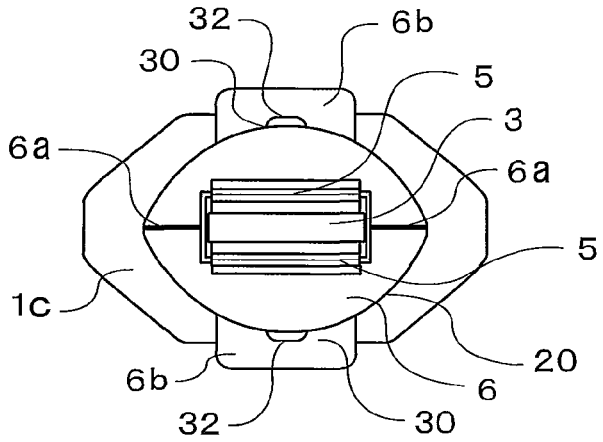
FIG. 4 is a simplified overhead view corresponding to FIG. 3.

As will be apparent from FIGS. 2 and 4, the sealing member 3 comprises a rectangular joint portion 3*a* for the paired lid segments and a sealing portion 3*b* formed integrally with the joint portion 3*a* adapted to cover the tip opening 2 of the tubular neck 4. The connecting web 5 are flexible rectangular hinge members serving for flexibly connecting the paired expandable lid segments 6 of the lid member 20 to laterals of the sealing member 3 so that the paired lid segments 6 may horizontally expand. The tubular neck 4 is formed below the tip opening 2 with locking protrusions 7, 8 ensuring that an infusion tube may be reliably connected to the tubular neck 4.

In the case of the illustrated embodiment, the expandable lid is bisected along a segmenting line 6*a* extending along a major axis of the substantially oval lid member 20 and these paired expandable segments cooperate with each other to define the complete lid member 20.

Embodiment 2

Figure 8:
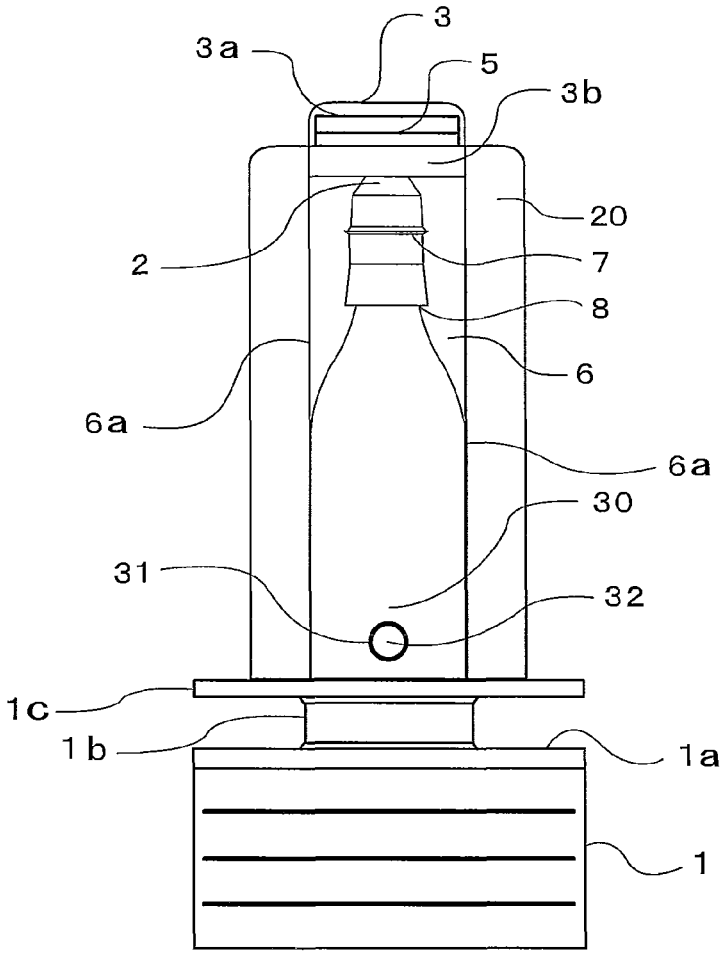
FIG. 8 is a simplified front longitudinal sectional view illustrating the pour spout member according to another embodiment.
Figure 9:
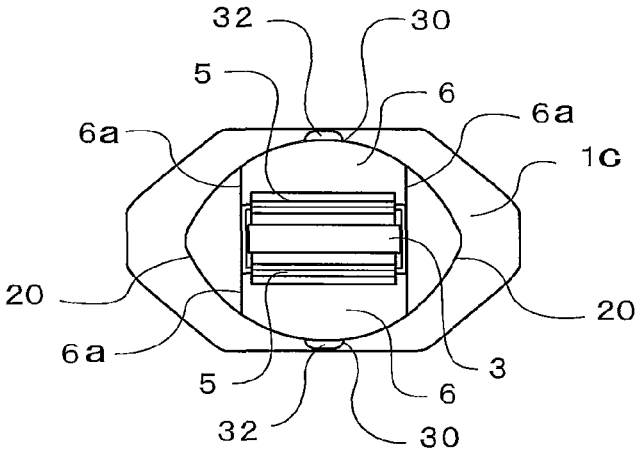
FIG. 9 is a simplified overhead view thereof.
Figure 10:
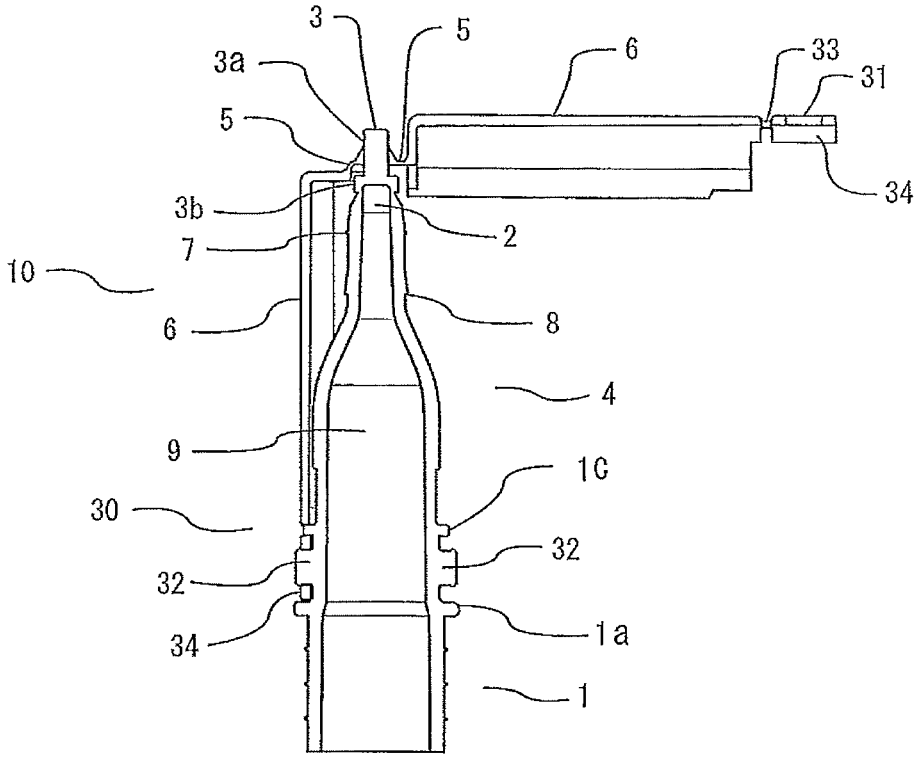
FIG. 10 is a simplified front longitudinal sectional view illustrating a manner of utilization of a pour spout member according to another embodiment of the present invention.

According to an embodiment illustrated by FIGS. 8 and 9, the paired expandable lid segments 6 are formed by segmenting a part of the lid member 20 along segmenting lines 6*a*, i.e., these paired expandable lid segments 6 partially define the lid member 20.

While not illustrated, such arrangement that the paired expandable lid segments 6 partially define the lid member 20 includes also an arrangement that respective upper ends of the expandable lid segments 6 are hinged to the lid member 20 which is integral with the sealing member 3 so that the expandable lid segments 6 partially defining the lid member 20 may be connected to the lid member 20 in expandable and collapsible manner.

Each of the respective segmenting lines 6*a* defining joints between the respective expandable lid segments 6 and the lid member 20 integral with the sealing member 3 may be formed with appropriate joint surfaces adapted to be detachably engaged with each other such as engage able L-shaped grooves or ridge/groove of well-known art in order to prevent the expandable lid segments from unintentionally expanding.

The rotation locking mechanism 30 is provided between the expandable lid segments 6 in collapsed positions and the tubular neck 4 to prevent these lid segments 6 from readily expanding but under a sufficiently weak locking force to allow the user to release the locking effect with his or her finger. While such locking means comprise depressions 31 formed on the respective expandable lid segments 6 and protrusions 32 formed on the tubular neck 4 adapted to be engaged with the associated depressions 31 in the case of the illustrated embodiment, it is also possible to use the other mechanism of well-known art such as elastic snap mechanism or retainer mechanism both consisting of elements adapted to be detachably engaged with each other, or pressure-sensitive surface adhesive or surface fasteners.

With the arrangement as has been described just above, the lid member 20 is locked on the tubular neck 4 by the rotation locking mechanism 30 so long as the expandable lid segments 6 of the lid member 20 attached to the tubular neck 4 are kept in collapsed state. In this way, the lid member 20 is sufficiently locked on the tubular neck 4 in the expanding direction as well as in the rotational direction to eliminate the anxiety that the sealing member 3 might be unintentionally twisted off from the tubular neck 4 in transit.

The expandable lid segments 6 of the lid member 20 which has been locked on the tubular neck 4 by the rotation locking mechanism 30 may be unlocked by the user to expand them and then these expanded lid segments 6 may be rotated to twist off the sealing member 3 having been fixed to the tubular neck 4 smoothly and without laying a hand on the tubular neck 4.

Figure 5:
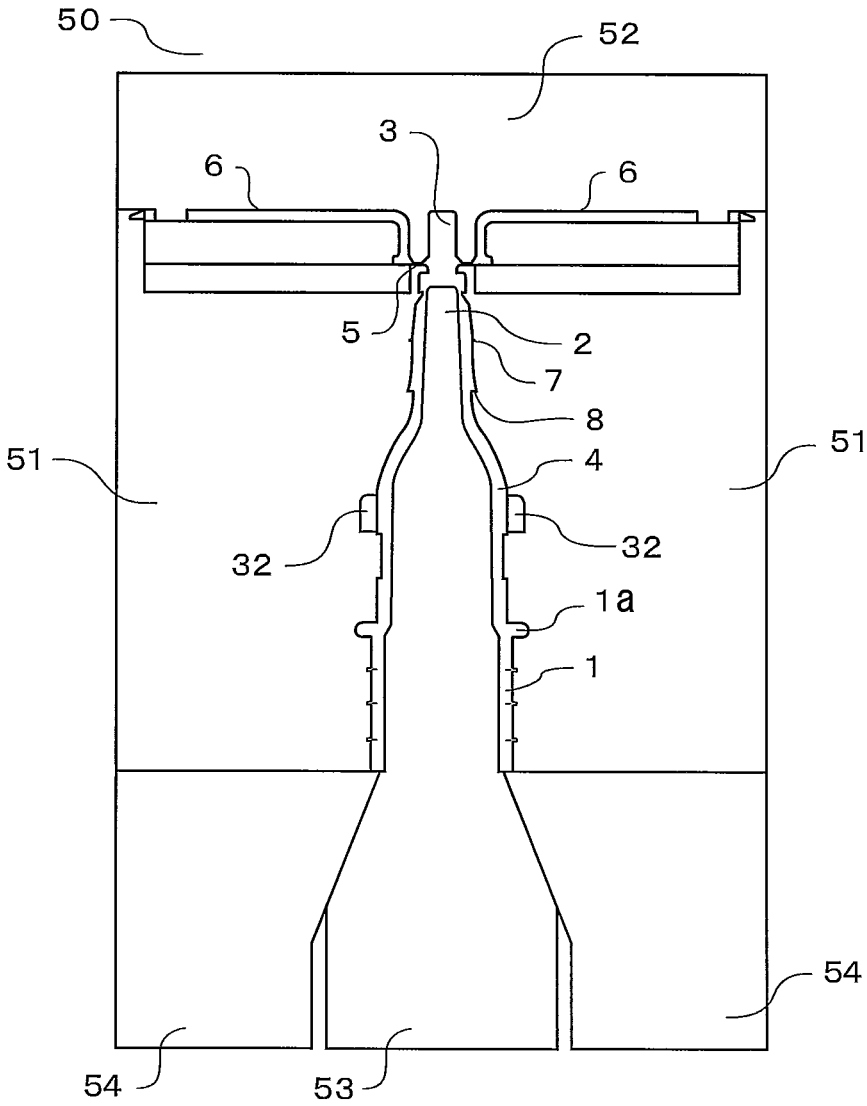
FIG. 5 is a simplified front longitudinal sectional view illustrating a molding tool used to mold the embodiment of the pour spout member.
Figure 6:
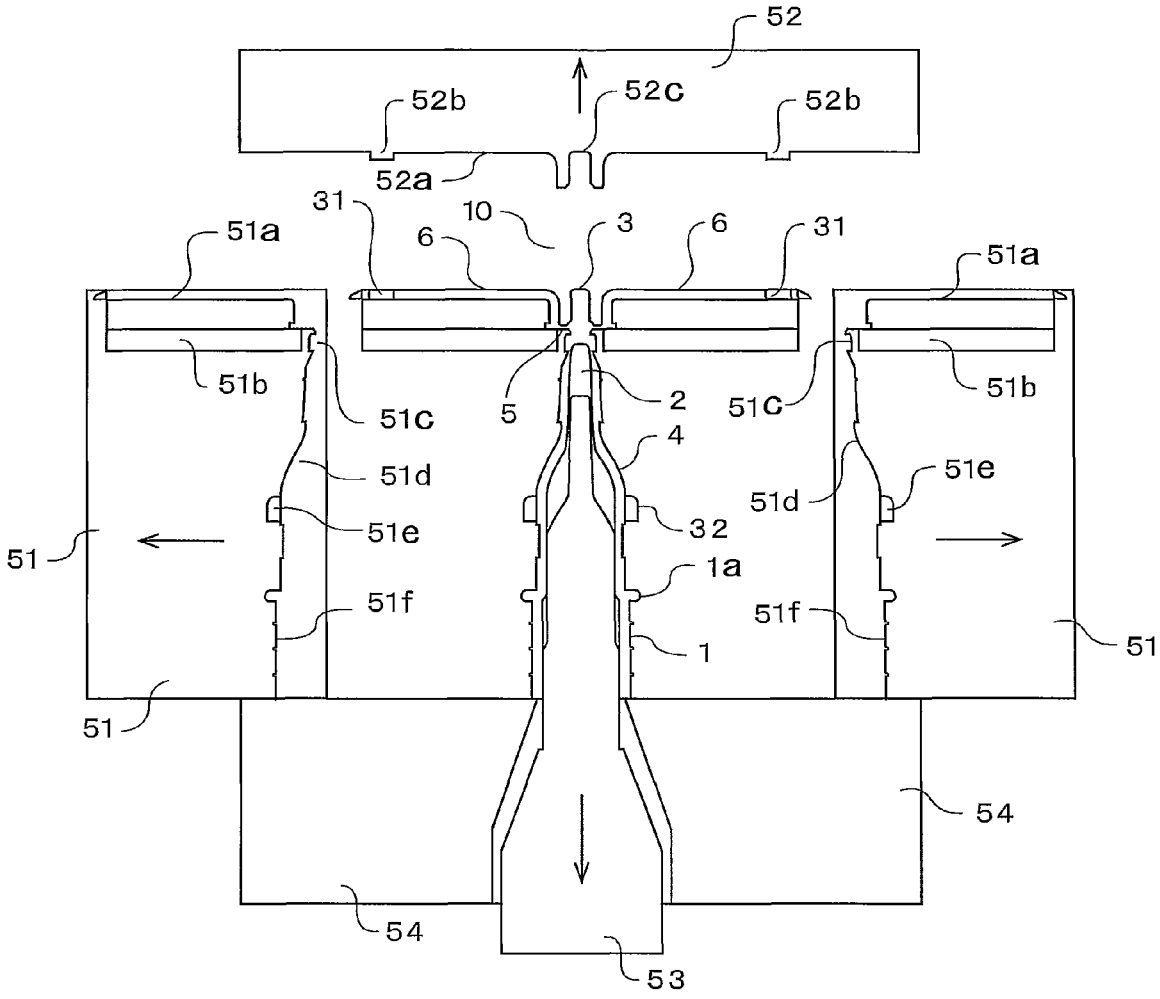
FIG. 6 is a simplified front longitudinal sectional view illustrating the molding tool in a step of mold opening.

Embodiment 3 the pour spout member 10 for packaging bag according to the present invention constructed as has been described above may be obtained, as illustrated by FIGS. 5 and 6, by a plastic monolithic injection molding using a molding tool 50. The molding tool 50 comprises right and left lateral molds 51 serving to, keeping the expandable lid segments 6 expanded in substantially horizontal state, mold right and left side surfaces of the tubular neck 4 and respective inner surfaces of the expandable lid segments 5 and vertically movable top and bottom forces 52, 53 serving to mold the sealing member 3 inclusive of the tubular neck interior 9 and the connecting webs 5 and respective outer surfaces of the expandable lid segments 6. Reference numeral 54 designates a stationary mold.

the lateral molds 51 are bilaterally symmetric and kept in closed positions as shown in FIG. 5 in the course of injection molding. When plastic material has been sufficiently cooled and hardened to be removed from the mold tool, these lateral molds 51 may be laterally moved as shown in FIG. 6 to mold the right and left side surface of the tubular neck 4 and the inner surfaces of the expandable lid segments 5. Reference numerals 51*a*, 51*b* designate mold parts serving to mold the respective inner surfaces of the expandable lid segments 6, reference numeral 51*c* designates a mold part serving to mold respective lower sides of the sealing portion 3*b* and the connecting webs 5, reference numeral 51*d* designates a mold part serving to mold the outer periphery of the tubular neck 4, reference numeral 51*e* designates a mold part serving to mold a protrusion 32 of the rotation locking mechanism 30 and reference numeral 51*f* designates a mold part serving to mold the base 1.

The vertically movable top force 42 lies above the lateral molds 51 in the course of molding as illustrated by FIG. 5 and serves to mold respective upper sides of the sealing member 30 and the expandable lid segments 6. After hardening, the top force 42 moves upward as illustrated in FIG. 6. The vertically movable top force 52 comprises a mold part 52*a* serving to mold respective upper surfaces of the expandable lid segments 6, protruding mold parts 52*b* serving to mold the depressions 31 of the rotation locking mechanism 30 and a mold part 52*c* lying in the middle of the top force 52 and serving to mold respective upper sides of the sealing member 3 and the connecting webs 5.

the vertically movable bottom force 53 is so-called core serving to inner space of the tubular neck 4 and adapted to slide downward in the step of mold opening until the pour spout member 10 according to the invention is removed from the mold tool onto the stationary mold 54 as illustrated in FIG. 6. In this manner, the operation of molding is completed. It should be appreciated that a mold part serving to mold the handgrip 6*b* is not shown in FIGS. 5 and 6.

In the monolithic injection molding as has been described in reference with FIG. 6, operation of the mold opening is carried out in the order as follows. First, the right and left lateral molds 51 are opened by laterally sliding them, then the vertically movable top force 52 is moved upward and thereafter the vertically movable bottom force 53 is moved downward so that the pour spout member 10 having its lower end supported on the stationary mold 54 is removed from the mold tool 50.

In view of such mold opening sequence, in the case of the pour spout member 6 for packaging bag according to the present invention, each of the paired expandable lid segments 6 of the lid member 20 will have inner side shape allowing the lateral molds 61 to be smoothly removed. Each of the paired expandable lid segments 6 may have cross-sectional shape being uniform from its proximal end in the vicinity of the connecting web 5 to the sealing member 3 to the distal end, for example, circular, oval, triangular, polygonal or curved cross-sectional shape of a combination thereof. While it is obviously possible for each of the paired expandable lid segments 6 to have the cross-sectional shape defined by an inner diameter being uniform from its proximal end in the vicinity of the connecting web 5 to the sealing member 3 to the distal end, it is also possible for each of the expandable lid segments to have the cross-sectional shape defined by the inner diameter gradually or stepwise increasing from its proximal end in the vicinity of the connecting web 5 to the sealing member 3 to the distal end.

The shapes of the expandable lid segments 6 on the upper sides thereof may be appropriately selected so far as the vertically movable top force can be easily released and therefore the expandable lid segments 6 may be selectively designed as the outer shape of the lid member 20.

Embodiment 4

In the embodiment illustrated by FIGS. 10 through 16, the pour spout member 10 for packing bag according to the present invention comprises the hollow base 1 adapted to be heat sealed to the packaging bag, the tubular neck 4 having its tip opening 2 sealed by the sealing member 3 and the lid member 20 having its upper end connected to the sealing member 3 by the connecting webs 5 so as to cover the outer periphery of the tubular neck 4. In this pour spout member 10, the lid member 20 includes the paired expandable lid segments 6 having respective upper ends connected to the portion integral with said sealing member 3 and segmented in an expandable manner. The outer surface of the expandable lid segment 6 has a substantially oval cross-sectional shape. Specifically, said portion integral with the sealing member 3 to which the respective upper ends of the paired expandable lid segments 6 are connected, these paired expandable lid segments 6 and a part of the skirt portion of the lid member 20 integral with the sealing member 3 collectively define the lid member 20 as a whole as will be apparent from FIGS. 10 through 16. It should be noted here that the expandable lid segment 6 is not limited to the paired expandable lid segments 6 as those in the illustrated embodiment but may be a single or three or more expandable lid segments. In addition, while the tubular neck 4 has a circular cross-sectional shape in the illustrated embodiment, it is possible for the tubular neck 4 to have oval or polygonal cross-sectional shape.

The expandable lid segments 6 are provided at respective lower ends with expansion restricting pieces 34 by the intermediary of temporary links 33. Between the expansions restricting pieces 34 provided at the respective lower end of the expandable lid segments 6 in collapsed state and the tubular neck 4, there are provided the rotation locking mechanisms 30 functioning to lock rotation and expansion of the lid member 20 together with the expandable lid segments 6. The rotation locking mechanism 30 serves to prevent the expandable lid segments 6 in collapsed state and the portion integral with the tubular neck 4 from readily expanding. While such locking means comprise depressions 31 formed on the respective expandable lid segments 6 and protrusions 32 formed on the tubular neck 4 adapted to be engaged with the associated depressions 31 in the case of the illustrated embodiment, it is also possible to use the other mechanism of well-known art, such as an elastic snap mechanism or a retainer mechanism, both consisting of elements adapted to be detachably engaged with each other, or pressure-sensitive surface adhesive or surface fasteners. It is also possible to provide the rotation locking mechanism 30 between the expansion restricting pieces 34 and the temporary lid locking frame 1*c* to prevent the expandable lid segments 6 from easily expanding.

Figure 16:
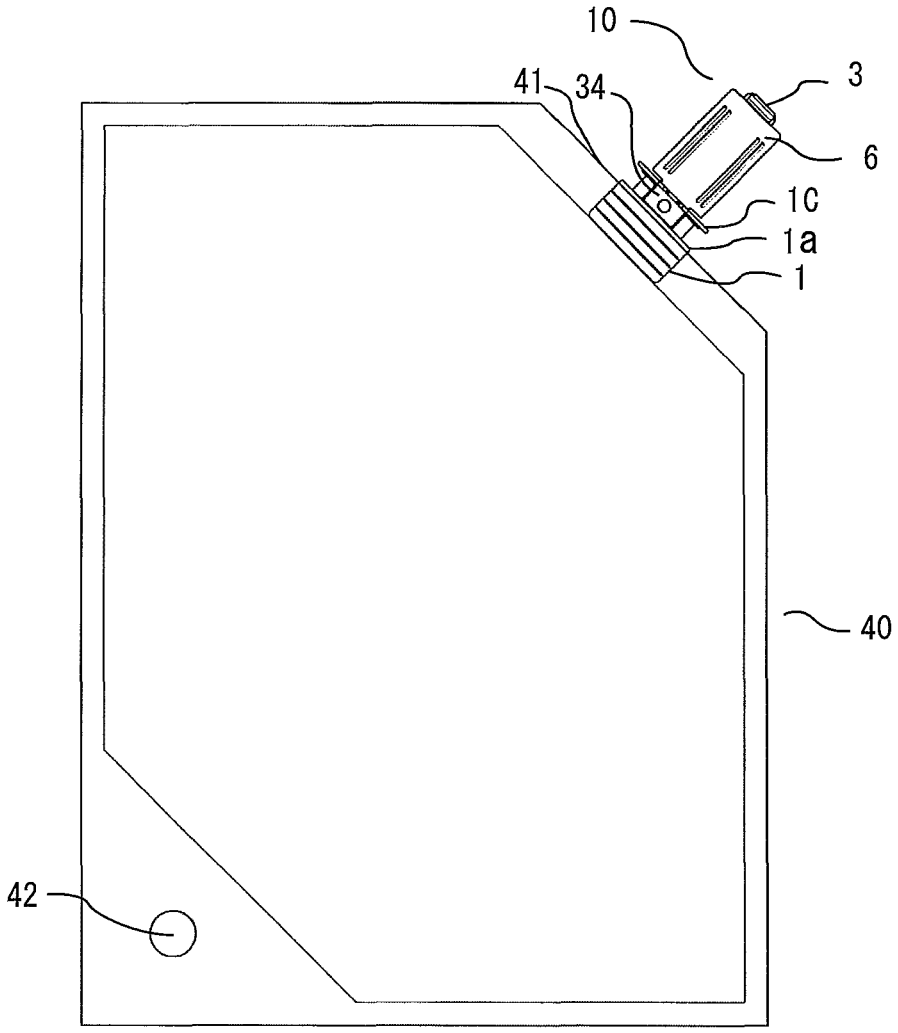
FIG. 16 is a schematic diagram illustrating a manner in which the pour spout member according to this embodiment is used.

As will be apparent from FIG. 16, the base 1 is provided with the apical plate 1*a* horizontally extending and serving as a top plate of a pour spout 41 of a packaging bag 40 when the base 1 is heat-sealed to this pour spout 41. As will be apparent from FIG. 12, above this apical plate 1*a*, the base 1 is provided with a temporary lid locking frame lc having a same shape as the apical plate 1*a* by the intermediary of a tubular spacer 1*b*. The tubular spacer 1*b* is formed with the protrusions 32 adapted to be engaged with the expansion restricting pieces 34. The links 33 are received by cutouts 36 formed in the temporary lid locking frames 1*c*. Referring to FIG. 16, reference numeral 42 designates a hole used for suspension of the bag 40.

As will be apparent from FIGS. 10 through 13, the sealing member 3 comprises a rectangular joint portion 3*a* for the paired lid segments and a sealing portion 3*b* formed integrally with the joint portion 3*a* adapted to cover the tip opening 2 of the tubular neck 4. The connecting web 5 are flexible rectangular hinge members serving for flexibly connecting the paired expandable lid segments 6 of the lid member 20 to laterals of the sealing member 3 so that the paired lid segments 6 may horizontally expand. The tubular neck 4 is formed below the tip opening 2 with locking protrusions 7, 8 ensuring that an infusion tube may be reliably connected to the tubular neck 4. Reference numeral 9 designates a tubular neck interior.

Figure 11:
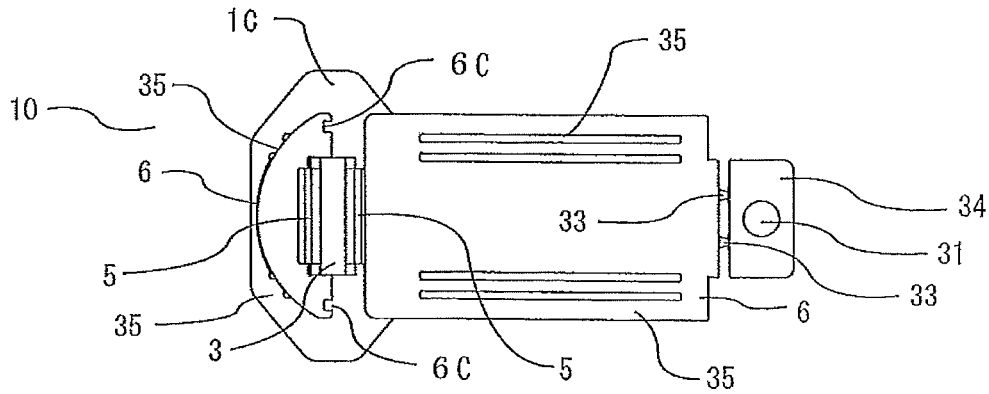
FIG. 11 is a simplified overhead view thereof.
Figure 12:
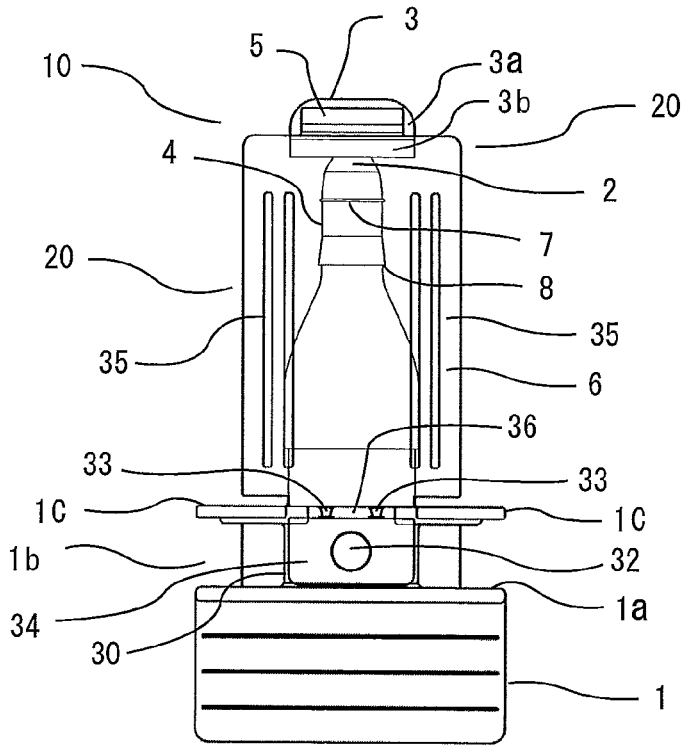
FIG. 12 is a manner of utilization thereof with the expandable lid segments in collapsed state.
Figure 13:
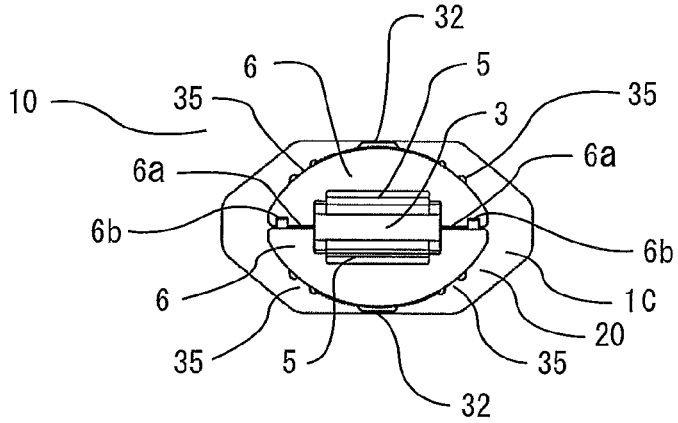
FIG. 13 is a simplified overhead view thereof.

As will be apparent from FIG. 13, in the case of the illustrated embodiment, the expandable lid is bisected along a segmenting line 6*a* extending along a major axis of the substantially oval lid member 20 and these paired expandable segments cooperate with each other to define the complete lid member 20. Referring to FIG. 11 or 13, the upper horizontal portions of the paired expandable lid segments 6 are formed with two sets 6*c* of concavity and convexity adapted to be put in engagement so as to serve as reinforcing means to keep the expandable lid segments 6 in collapsed state when the expansion restricting pieces 34 are cut off from the expandable lid segments 6 at the links 33. Reference numeral 35 designates ant slip ridges formed on the outer surface of the expandable lid segments 6.

Alternatively, the expandable lid segment 6 may be segmented by segmenting a part of the lid member 20 along segmenting lines so that the paired expandable lid segments 6 form a part of the lid member 20. While not illustrated, such arrangement that the paired expandable lid segments 6 partially define the lid member 20 includes also an arrangement that respective upper ends of the expandable lid segments 6 are hinged to the lid member 20 which is integral with the sealing member 3 so that the expandable lid segments 6 partially defining the lid member 20 may be connected to the lid member 20 in expandable and collapsible manner.

Each of the respective segmenting lines 6*a* defining joints between the respective expandable lid segments 6 and the lid member 20 integral with the sealing member 3 may be formed with appropriate joint surfaces adapted to be detachably engaged with each other such as engage able L-shaped grooves or ridge/groove of well-known art in order to prevent the expandable lid segments from unintentionally expanding.

With the arrangement as has been described just above, the lid member 20 is locked on the tubular neck 4 by the rotation locking mechanism 30 so long as the expandable lid segments 6 of the lid member 20 attached to the tubular neck 4 are kept in collapsed state. In this way, the lid member 20 is sufficiently locked on the tubular neck 4 in the expanding direction as well as in the rotational direction to eliminate the anxiety that the sealing member 3 might be unintentionally twisted off from the tubular neck 4 in transit.

The expandable lid segments 6 of the lid member 20 having been locked on the tubular neck 4 by the rotation locking mechanism 30 may be rotated with user's hand to break the links 33 and thereby to release the lid member 20 from the expansion restricting mechanism 34. Thus the lid member 20 may be continuously rotated and thereby the sealing member 3 having been fixed to the tubular neck 4 may be easily twisted off without laying a hand on the tubular neck 4.

the pour spout member according to the present invention has an irreversible construction. Specifically, once the expansion restricting mechanism 34 has been separated from the expandable lid segments 6 of the lid member 20, unsealing of the lid member 20 is demonstrated and it is no more possible to seal the pour spout member. With such construction, there is no apprehension that the used packaging bag 40 might be reused or erroneously used. In other words, the state in which the expandable lid segments 6 are connected to the expansion restricting pieces 34 via the links 33 and locked on the tubular neck 4 demonstrates that the packaging bag 40 is fresh.

Figure 14:
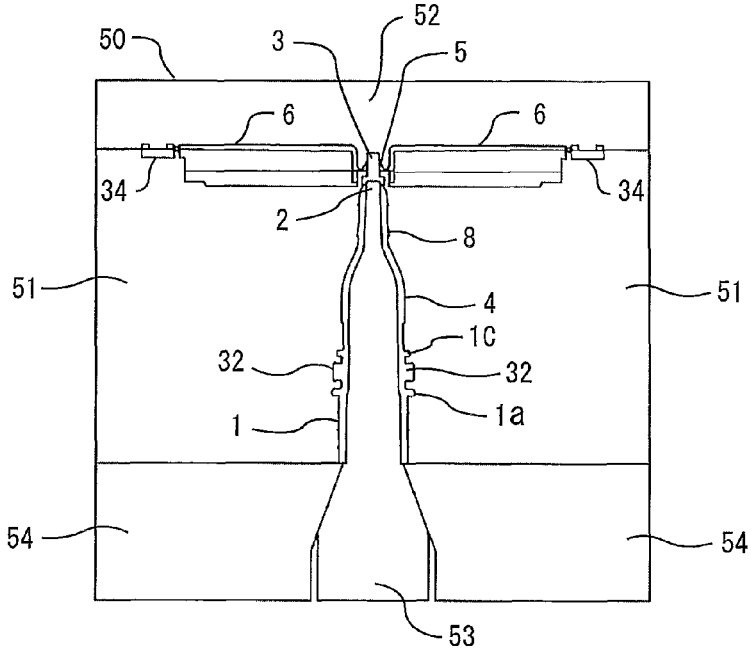
FIG. 14 is a simplified front longitudinal sectional view illustrating the molding tool used to mold the embodiment of the pour spout member.

Embodiment 5 the pour spout member 10 for packaging bag according to the present invention constructed as has been described above may be obtained, as illustrated by FIGS. 14 and 15, by a plastic monolithic injection molding using a molding tool 50. The molding tool 50 comprises right and left lateral molds 51 serving to, keeping the expandable lid segments 6 expanded in substantially horizontal state, mold right and left side surfaces of the tubular neck 4 and respective inner surfaces of the expandable lid segments 5 and vertically movable top and bottom forces 52, 53 serving to mold the sealing member 3 inclusive of the tubular neck interior 9 and the connecting webs 5 and respective outer surfaces of the expandable lid segments 6. Reference numeral 54 designates a stationary mold.

the lateral molds 51 are bilaterally symmetric and kept in closed positions as shown in FIG. 14 in the course of injection molding. When plastic material has been sufficiently cooled and hardened to be removed from the mold tool, these lateral molds 51 may be laterally moved as shown in FIG. 6 to mold the right and left side surface of the tubular neck 4 and the inner surfaces of the expandable lid segments 5. Reference numerals 51*a*, 51*b* designate mold parts serving to mold the respective inner surfaces of the expandable lid segments 6, reference numeral 51*c* designates a mold part serving to mold respective lower sides of the sealing portion 3*b* and the connecting webs 5, reference numeral 51*d* designates a mold part serving to mold the outer periphery of the tubular neck 4, reference numeral 51*e* designates a mold part serving to mold a protrusion 32 of the rotation locking mechanism 30 and reference numeral 51*f* designates a mold part serving to mold the base 1.

Figure 15:
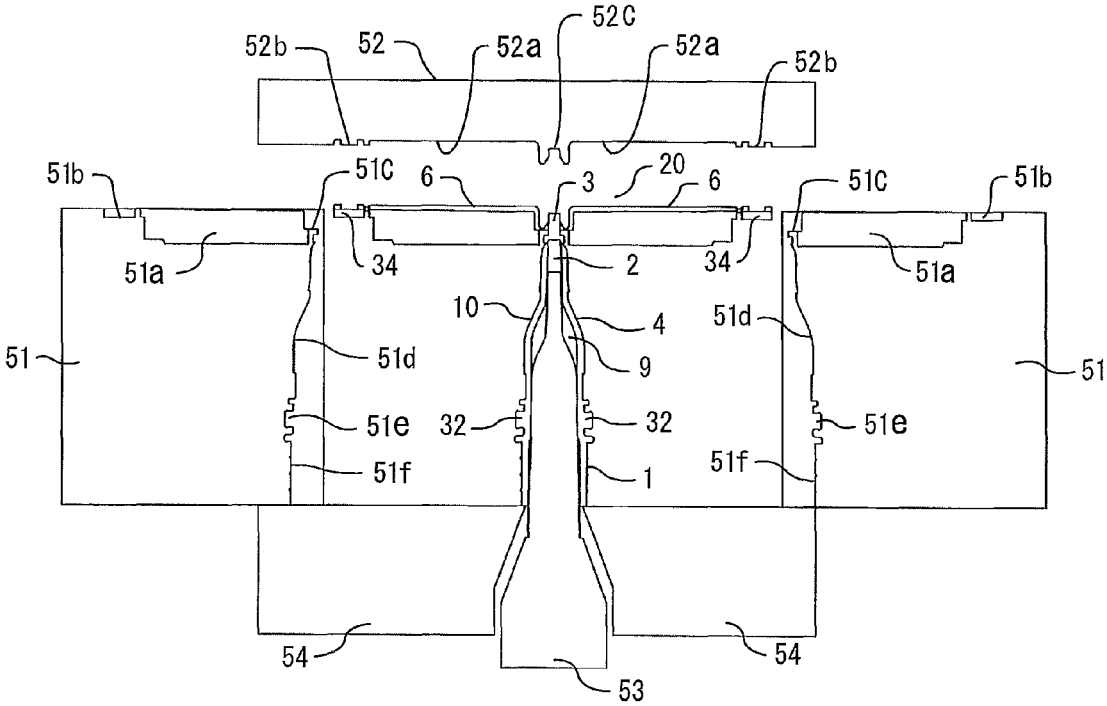
FIG. 15 is a simplified front longitudinal sectional view illustrating the molding tool in a step of mold opening.

The vertically movable top force 42 lies above the lateral molds 51 in the course of molding as illustrated by FIG. 14 and serves to mold respective upper sides of the sealing member 30 and the expandable lid segments 6. After hardening, the top force 42 moves upward as illustrated in FIG. 15. The vertically movable top force 52 comprises a mold part 52*a* serving to mold respective upper surfaces of the expandable lid segments 6, protruding mold parts 52*b* serving to mold the depressions 31 of the rotation locking mechanism 30 and a mold part 52*c* lying in the middle of the top force 52 and serving to mold respective upper sides of the sealing member 3 and the connecting webs 5.

the vertically movable bottom force 53 is so-called core serving to inner space of the tubular neck 4 and adapted to slide downward in the step of mold opening until the pour spout member 10 according to the invention is removed from the mold tool onto the stationary mold 54 as illustrated in FIG. 15. In this manner, the operation of molding is completed.

In the monolithic injection molding as has been described in reference with FIG. 15, operation of the mold opening is carried out in the order as follows. First, the right and left lateral molds 51 are opened by laterally sliding them, then the vertically movable top force 52 is moved upward and thereafter the vertically movable bottom force 53 is moved downward so that the pour spout member 10 having its lower end supported on the stationary mold 54 is removed from the mold tool 50.

In view of such mold opening sequence, in the case of the pour spout member 6 for packaging bag according to the present invention, each of the paired expandable lid segments 6 of the lid member 20 will have inner side shape allowing the lateral molds 61 to be smoothly removed. Each of the paired expandable lid segments 6 may have cross-sectional shape being uniform from its proximal end in the vicinity of the connecting web 5 to the sealing member 3 to the distal end, for example, circular, oval, triangular, polygonal or curved cross-sectional shape of a combination thereof. While it is obviously possible for each of the paired expandable lid segments 6 to have the cross-sectional shape defined by an inner diameter being uniform from its proximal end in the vicinity of the connecting web 5 to the sealing member 3 to the distal end, it is also possible for each of the expandable lid segments to have the cross-sectional shape defined by the inner diameter gradually or stepwise increasing from its proximal end in the vicinity of the connecting web 5 to the sealing member 3 to the distal end.

The shapes of the expandable lid segments 6 on the upper sides thereof may be appropriately selected so far as the vertically movable top force can be easily released and therefore the expandable lid segments 6 may be selectively designed as the outer shape of the lid member 20.

obviously, the scope as well as the spirit of the present invention is not limited to the embodiments as having been described above.

IDENTIFICATION OF REFERENCE NUMERALS USED IN THE DRAWINGS

1 base
1*a* base's apical plate
1*b* tubular spacer
1*c* temporary lid locking frame
2 tip opening
3 sealing member
3*a* joint portion
3*b* sealing portion
4 tubular necks
5 connecting web
6 expandable lid segments
6*a* segmenting line
6*b* handgrip
6*c* two sets of concavity
7 locking protrusion
8 locking protrusion
9 tubular necks interior
10 pour spout member
20 lid member
30 rotation locking mechanism
31 depressions
32 protrusions
33 links
34 expansion restricting piece
35 ridges
40 packaging bag
41 pour spout
42 hole for suspension of bag
50 molding tool

The invention claimed is:

1. A pour spout member for a packaging bag, comprising:

a base adapted to be attached to a packaging bag;

a tubular neck formed integrally with the base and having a tip opening sealed by a sealing member, the sealing member including a rectangular joint portion and a sealing portion, and being adapted to be rotated in order to be cut-off from the tip opening of the tubular neck, thereby opening the tip opening of the tubular neck; and a lid member having an upper end integrally joined to the rectangular joint portion of the sealing member by an intermediary of a connecting web formed of a hinge member; and an expandable lid segment attached to the lid member which are rotated integrally with the sealing member, the expandable lid segment having an upper end that is joined to the rectangular joint portion of the sealing member in order to be foldable along the connecting web onto a lateral side of the sealing member, and to be openable in a horizontal direction; and further comprising:

a releasable rotation locking mechanism for providing temporary restriction of the lid member provided between the expandable lid segment.

2. The pour spout member defined by claim 1, wherein the rotation locking mechanism temporarily locks the expandable lid segment.

3. The pour spout member defined by claim 1, wherein the expandable lid segment of the lid member is provided at a distal end thereof with a handgrip used to expand the lid segment.

4. The pour spout member defined by claim 1, wherein a distal end of the expandable lid segment of the lid member is connected with an expansion restricting piece an intermediary link, the rotation locking mechanism serving to prevent the expansion restricting piece from being released until the link is broken.

5. The pour spout member defined by claim 4, wherein the link is a breakable link.

6. The pour spout member defined by claim 4, wherein the expansion restricting piece remains on the tubular neck after the rotation locking mechanism has released the expandable lid segment from the tubular neck.

7. The pour spout member defined by claim 4, wherein the rotation locking mechanism is provided with a temporary lid locking frame.

8. The pour spout member defined by claim 1, wherein the expandable lid segment has an outside shape defined by an oval cross-sectional shape uniformly from its upper end connected to the sealing member at a distal end thereof.

9. The pour spout member defined by claim 1, wherein the lid member includes a pair of expandable lid segments each of which is openable in the horizontal direction.

10. The pour spout member defined by claim 9 wherein each of the expandable lid segments includes an expansion restricting piece being expanded in a horizontal position, wherein the pour spout member is formed of plastic molded by a molding tool comprising:

lateral molds serving to mold right and left sides of the tubular neck and respective inner sides of the expandable lid segments, and a top member and a bottom member applying top and bottom forces serving to mold an interior of the tubular neck, and the sealing member inclusive of the connecting web and an outer side of each of the expandable lid segments.

11. The pour spout member defined by claim 1, wherein the releasable rotation locking mechanism comprises:

a protrusion formed on the tubular neck and an opening or a depression formed in an expansion restricting piece adapted to be engaged with said protrusion.

12. The pour spout member defined by claim 2, wherein the expandable lid segment of the lid member is provided at a distal end thereof with a handgrip used to expand the lid segment.

13. The pour spout member defined by claim 5, wherein the expansion restricting piece remains on the tubular neck after the rotation locking mechanism has released the expandable lid segment from the tubular neck.

14. The pour spout member defined by claim 5, wherein the rotation locking mechanism is provided with a temporary lid locking frame.

15. The pour spout member defined by claim 6, wherein the rotation locking mechanism is provided with a temporary lid locking frame.

* * * * *